US006783221B2

(12) United States Patent
Phillips

(10) Patent No.: US 6,783,221 B2
(45) Date of Patent: Aug. 31, 2004

(54) PHASE CHANGE WASTE INK CONTROL APPARATUS AND METHOD

(75) Inventor: Scott J. Phillips, W. Henrietta, NY (US)

(73) Assignee: Xerox Corporation, Stamford, CT (US)

( * ) Notice: Subject to any disclaimer, the term of this patent is extended or adjusted under 35 U.S.C. 154(b) by 1 day.

(21) Appl. No.: 10/320,818

(22) Filed: Dec. 16, 2002

(65) Prior Publication Data

US 2004/0114006 A1 Jun. 17, 2004

(51) Int. Cl.[7] ..... B41J 2/165

(52) U.S. Cl. ..... 347/88; 347/29; 347/32; 347/33

(58) Field of Search ..... 347/22, 29, 30, 347/32, 33, 35, 88

(56) References Cited

U.S. PATENT DOCUMENTS

| | | | | |
|---|---|---|---|---|
| 4,636,803 A | | 1/1987 | Mikalsen | 346/1.1 |
| 4,739,339 A | | 4/1988 | DeYoung et al. | 346/1.1 |
| 5,038,157 A | | 8/1991 | Howard | 346/140 R |
| 5,172,140 A | * | 12/1992 | Hirabayashi et al. | 347/36 |
| 5,372,852 A | | 12/1994 | Titterington et al. | 427/288 |
| 6,053,608 A | | 4/2000 | Ishii et al. | 347/88 |
| D453,787 S | | 2/2002 | Mattern | D18/56 |

FOREIGN PATENT DOCUMENTS

JP 05278229 A * 10/1993 ..... B41J/2/18

* cited by examiner

*Primary Examiner*—Shih-Wen Hsieh
(74) *Attorney, Agent, or Firm*—Tallam I. Nguti

(57) ABSTRACT

A phase change waste ink control apparatus and method are provided and are suitable for use in a phase change ink image producing machine including a printhead system. The apparatus for the method includes (a) devices for producing phase change waste ink such as from a printhead system; (b) a waste ink gutter assembly, including a heating device, for collecting, accumulating and coalescing the phase change waste ink. The apparatus also includes (c) a controller for periodically turning the heating device on to heat and melt coalesced phase change waste ink within the waste ink gutter assembly; and (d) a waste ink collection container for collecting melted phase change waste ink from the waste ink gutter assembly.

18 Claims, 4 Drawing Sheets

PHASE CHANGE WASTE INK CONTROL APPARATUS AND METHOD

RELATED CASE

This application is related to U.S. application Ser. No. 10/320,826 entitled "Printhead Maintenance Apparatus And Method And A Phase Change Ink Image Producing Machine Using Same " filed on even date herewith, and having at least one common inventor.

BACKGROUND OF THE INVENTION

This invention relates generally to image producing machines such as copiers, printers, facsimile machines and the like which use phase change marking material or ink and printheads, and more particularly to a phase change waste ink control apparatus and method, and a phase change ink image producing machine using same.

In general, phase change ink image producing machines or printers employ phase change inks that are in the solid phase at ambient temperature, but exist in the molten or melted liquid phase (and can be ejected as drops or jets) at the elevated operating temperature of the machine or printer. At such an elevated operating temperature, droplets or jets of the molten or liquid phase change ink are ejected from a printhead device of the printer onto a printing media. Such ejection can be directly onto a final image receiving substrate, or indirectly onto an imaging member before transfer from it to the final image receiving media. In any case, when the ink droplets contact the surface of the printing media, they quickly solidify to create an image in the form of a predetermined pattern of solidified ink drops.

An example of such a phase change ink image producing machine or printer, and the process for producing images therewith onto image receiving sheets is disclosed in U.S. Pat. No. 5,372,852 issued Dec. 13, 1994 to Titterington et al. As disclosed therein, the phase change ink printing process includes raising the temperature of a solid form of the phase change ink so as to melt it and form a molten liquid phase change ink. It also includes applying droplets of the phase change ink in a liquid form onto an imaging surface in a pattern using a device such as an ink jet printhead. The process then includes solidifying the phase change ink droplets on the imaging surface, transferring them to the image receiving substrate, and fixing the phase change ink to the substrate.

Conventionally, the solid form of the phase change is a "stick", "block", "bar" or "pellet" as disclosed for example in U.S. Pat. No. 4,636,803 (rectangular block 24, cylindrical block 224); U.S. Pat. No. 4,739,339 (cylindrical block 22); U.S. Pat. No. 5,038,157 (hexagonal bar 12); U.S. Pat. No. 6,053,608 (tapered lock with a stepped configuration). Further examples of such solid forms are also disclosed in design patents such as U.S. Design Pat. No. D453,787 issued Feb. 19, 2002. In use, each such block form "stick", "block", "bar" or "pellet" is fed into a heated melting device that melts or phase changes the "stick", "block", "bar" or "pellet" directly into a print head reservoir for printing as described above.

Conventionally, phase change ink image producing machines or printers, particularly color image producing such machines or printers, are considered to be low throughput, typically producing at a rate of less than 30 prints per minute (PPM). The throughput rate (PPM) of each phase change ink image producing machine or printer employing solid phase change inks in such "stick", "block", "bar" or "pellet" forms is directly dependent on how quickly such a "stick", "block", "bar" or "pellet" form can be melted down into a liquid. The quality of the images produced depends on such a melting rate, and on the types and functions of other subsystems employed to treat and control the phase change ink as solid and liquid, the imaging member and its surface, the printheads, and the image receiving substrates.

There is therefore a need for a relatively high-speed phase change ink image producing machine or printer that is also capable of producing relatively high quality images, particularly color images on plain paper substrates.

SUMMARY OF THE INVENTION

In accordance with the present invention, there is provided a phase change waste ink control apparatus and method that are suitable for use in a phase change ink image producing machine including a printhead system. The apparatus for the method includes (a) devices for producing phase change waste ink such as from a printhead system; (b) a waste ink gutter assembly, including a heating device, for collecting, accumulating and coalescing the phase change waste ink. The apparatus also includes (c) a controller for periodically turning the heating device on to heat and melt coalesced phase change waste ink within the waste ink gutter assembly; and (d) a waste ink collection container for collecting melted phase change waste ink from the waste ink gutter assembly.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
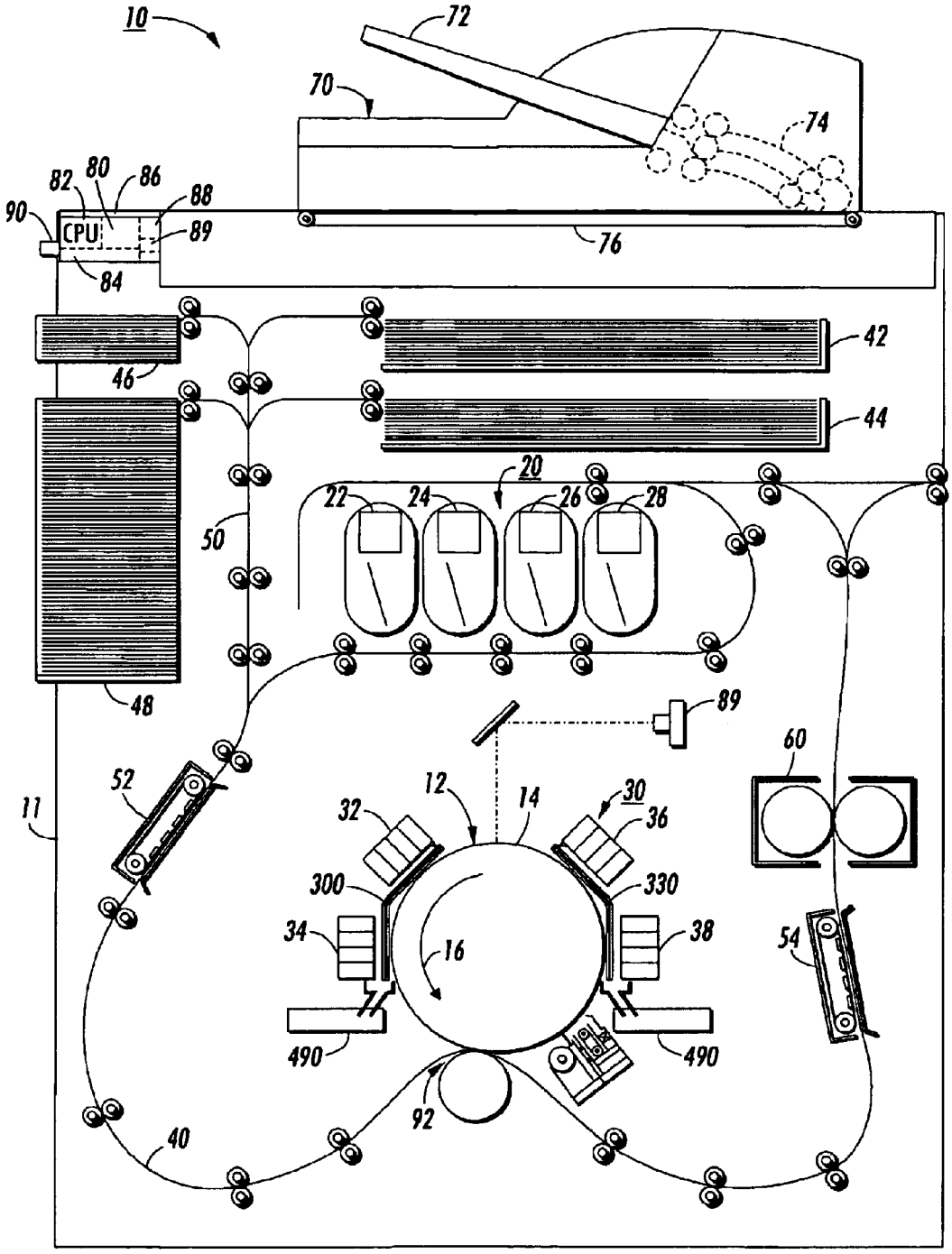
FIG. 1 is a vertical schematic of an image producing machine in the form of an exemplary phase change ink image producing machine using the phase change waste ink control apparatus and method of the present invention.

Referring now to FIG. 1, there is illustrated an image producing machine, such as the high-speed phase change ink image producing machine or printer 10 of the present invention. As illustrated, the machine 10 includes a frame 11 to which are mounted directly or indirectly all its operating subsystems and components, as will be described below. To start, the high-speed phase change ink image producing machine or printer 10 includes an imaging member 12 that is shown in the form of a drum, but can equally be in the form of a supported endless belt. The imaging member 12 has an imaging surface 14 that is movable in the direction 16, and on which phase change ink images are formed.

The high-speed phase change ink image producing machine or printer 10 also includes a phase change ink delivery subsystem 20 that has at least one source 22 of one color phase change ink in solid form. Since the phase change ink image producing machine or printer 10 is a multicolor image producing machine, the ink delivery system 20 includes four (4) sources 22, 24, 26, 28, representing four (4) different colors CYMK (cyan, yellow, magenta, black) of phase change inks. The phase change ink delivery system also includes a melting and control apparatus (not shown in FIG. 1) for melting or phase changing the solid form of the phase change ink into a liquid form. The phase change ink delivery system is suitable for then supplying the liquid form to a printhead system 30 including at least one printhead assembly 32. Since the phase change ink image producing machine or printer 10 is a high-speed, or high throughput, multicolor image producing machine, the printhead system 30 includes multicolor ink printhead assemblies and a plural number (e.g. four (4)) of separate printhead assemblies 32, 34, 36 and 38 as shown. In order to achieve and maintain relatively high quality image productions by the printhead assembly, the machine 10 includes the printhead maintenance apparatus and method 300, 330 of the present invention (to be described in detail below).

As further shown, the phase change ink image producing machine or printer 10 includes a substrate supply and handling system 40. The substrate supply and handling system 40 for example may include substrate supply sources 42, 44, 46, 48, of which supply source 48 for example is a high capacity paper supply or feeder for storing and supplying image receiving substrates in the form of cut sheets for example. The substrate supply and handling system 40 in any case includes a substrate handling and treatment system 50 that has a substrate pre-heater 52, substrate and image heater 54, and a fusing device 60. The phase change ink image producing machine or printer 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 for example is a self-contained, dedicated mini-computer having a central processor unit (CPU) 82, electronic storage 84, and a display or user interface (UI) 86. The ESS or controller 80 for example includes sensor input and control means 88 as well as a pixel placement and control means 89. In addition the CPU 82 reads, captures, prepares and manages the image data flow between image input sources such as the scanning system 76, or an online or a work station connection 90, and the printhead assemblies 32, 34, 36, 38. As such, the ESS or controller 80 is the main multi-tasking processor for operating and controlling all of the other machine subsystems and functions, including timing and operation of the printhead maintenance apparatus and method 300, 330 of the present invention.

In operation, image data for an image to be produced is sent to the controller 80 from either the scanning system 76 or via the online or work station connection 90 for processing and output to the printhead assemblies 32, 34, 36, 38. Additionally, the controller determines and/or accepts related subsystem and component controls, for example from operator inputs via the user interface 86, and accordingly executes such controls. As a result, appropriate color solid forms of phase change ink are melted and delivered to the printhead assemblies. Additionally, pixel placement control is exercised relative to the imaging surface 14 thus forming desired images per such image data, and receiving substrates are supplied by anyone of the sources 42, 44, 46, 48 and handled by means 50 in timed registration with image formation on the surface 14. Finally, the image is transferred within the transfer nip 92, from the surface 14 onto the receiving substrate for subsequent fusing at fusing device 60.

Referring now to FIGS. 1–4, the phase change waste ink control apparatus 480 and method 500 of the present invention are further illustrated in greater detail. The apparatus 480 and method 500 are suitable for use in a phase change ink image producing machine such as machine 10. Such a machine should include (a) a control subsystem for controlling operation of all subsystems and components of the image producing machine and (b) a movable imaging member having an imaging surface. It should also include (c) a phase change ink system, (d) a printhead system connected to the control subsystem and to the phase change ink system for ejecting drops of liquid phase change ink onto the imaging surface to form an image, and (e) the phase change waste ink control apparatus 480.

Figure 2:
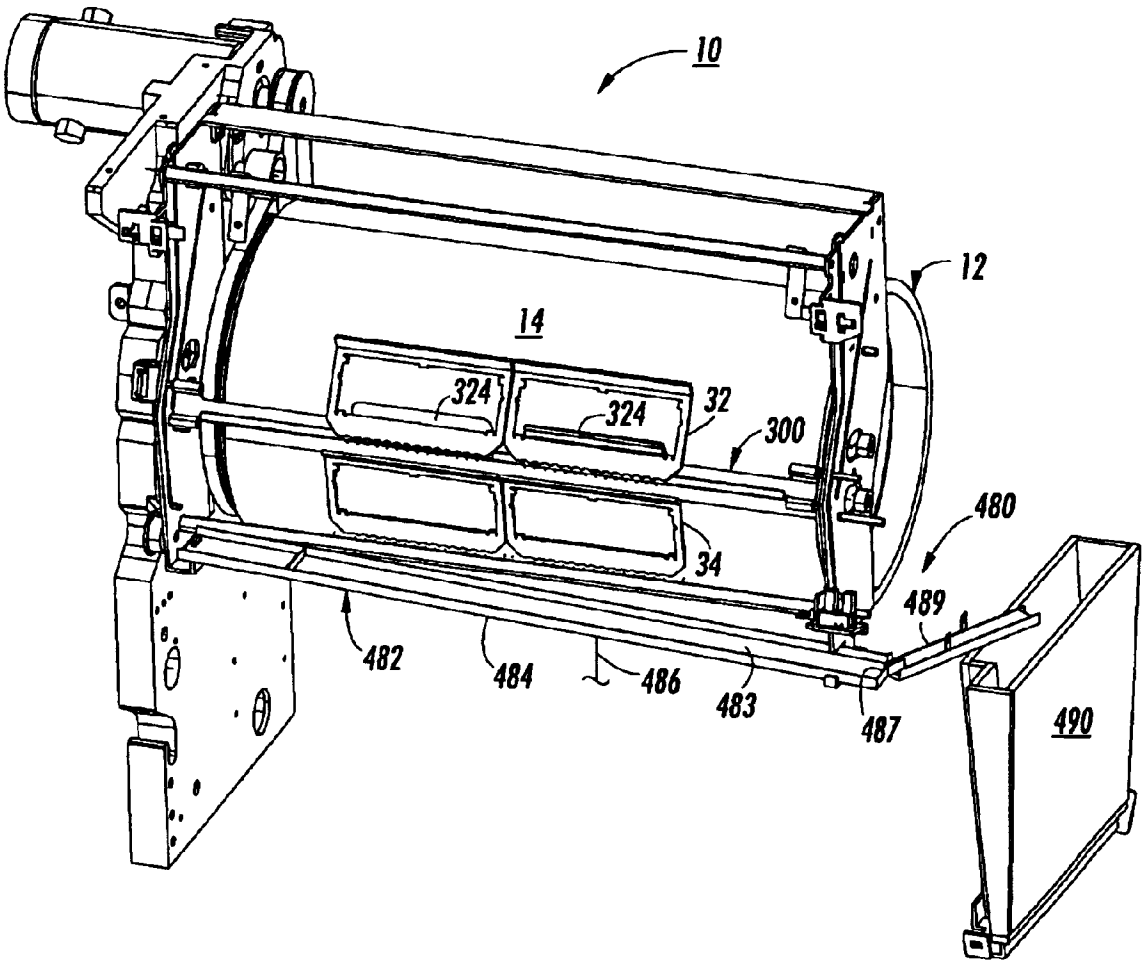
FIG. 2 is a perspective illustration of a printhead maintenance apparatus including a gutter assembly, and a waste container controlled according to the method of the present invention.
Figure 3:
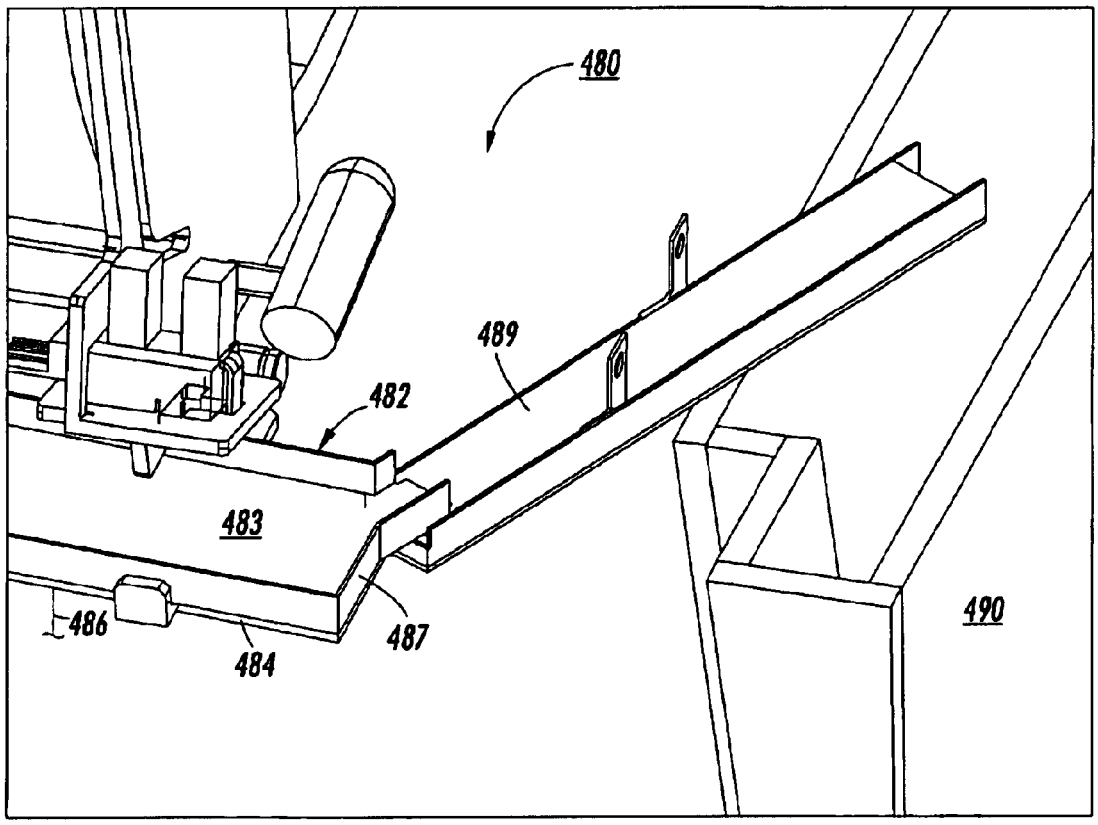
FIG. 3 is an enlarged view of an end portion of the gutter assembly and waste container of FIG. 2.

As shown in FIGS. 1–3, the phase change waste ink control apparatus 480 includes waste means for producing phase change waste ink from the printhead system. Such means for example include programmed means as part of the controller 80 for purging printheads of the printhead assemblies 32, 34, 36, 38, as well as the maintenance apparatus 300, 330. Maintenance apparatus 330 is identical 300, therefore mention or description of 300 is equally true of 330. As shown in FIG. 2, the maintenance apparatus 300 includes wiper blades 324 for wiping and removing liquid residual phase change waste from surfaces of printheads of the printhead assemblies 32, 34 for example.

The phase change waste ink control apparatus 480 also includes a waste ink gutter assembly 482 for collecting, accumulating and coalescing the phase change waste ink. The gutter assembly 482 includes a putter 483 and a heating device 484 that has means 486 that are connected to the controller 80 for turning the heating device 484 on and off. The controller 80 as part of the phase change waste ink control apparatus 480 is programmed to control various aspects thereof including periodically turning the heating device 484 on to heat and melt coalesced phase change waste ink within the waste ink gutter assembly 482. As further shown, the gutter assembly 482, includes a stop edge 487, a ramp 489 for control flow of melted waste ink into a waste collection container 490 for collecting melted phase change waste ink from the waste ink gutter assembly 482.

Figure 4:
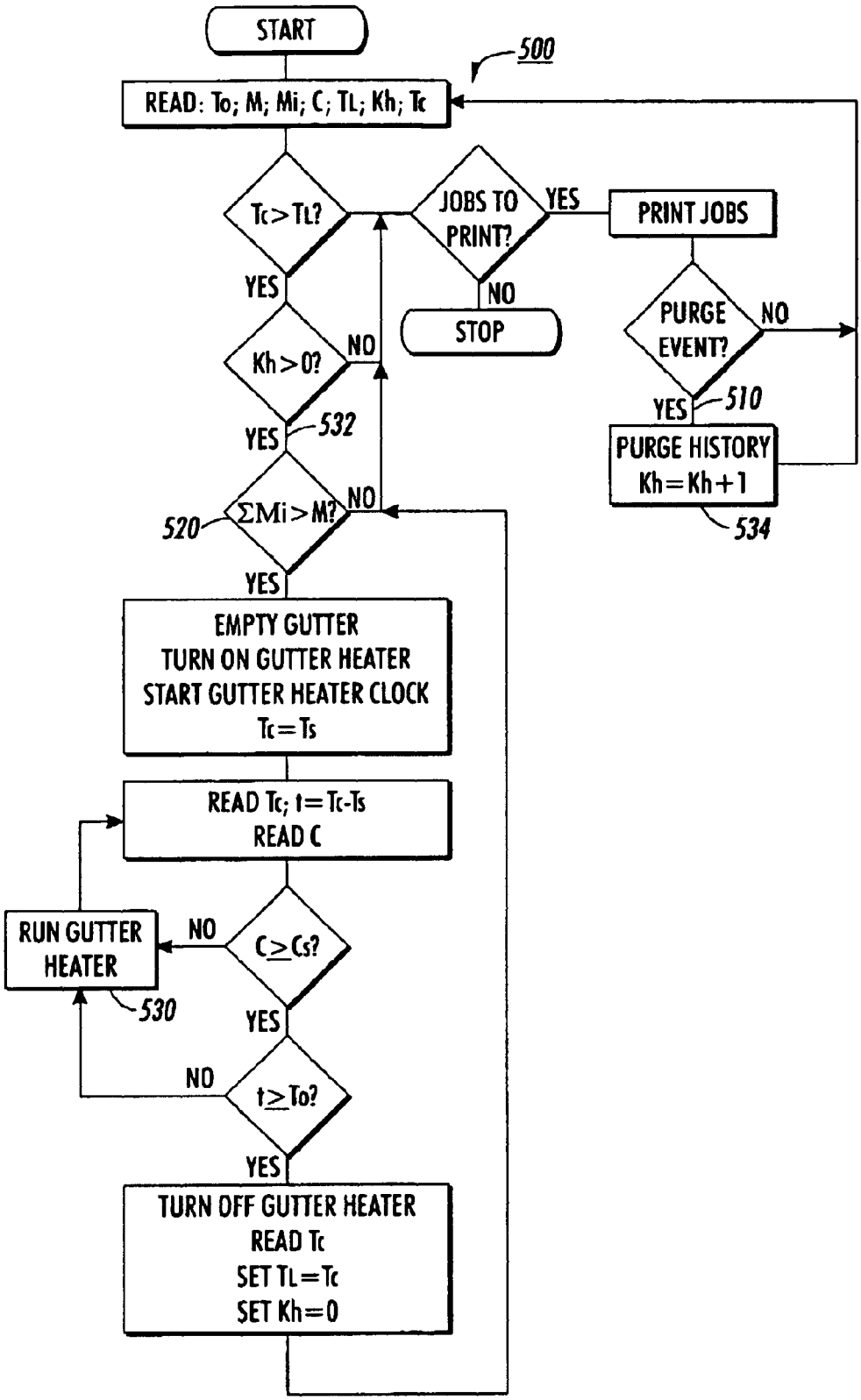
FIG. 4 is a flow chart of the phase change waste ink control method of the present invention.

In accordance with the present invention, as illustrated in FIG. 4, the heating device 484 is normally in an off mode for collecting, accumulating and coalescing phase change waste ink within the waste ink gutter assembly. The controller 80 is programmed for keeping the heating device in an on mode for a predetermined period of time To, for sensing and controlling a temperature C of the heating device at a predetermined control temperature Cs, and for determining whether a value of phase change ink (summation Mi) 520 accumulated within the waste ink gutter has reached a control value M therefor. The controller 80 is also programmed for keeping clock time and controlling a history Kh of waste ink producing events.

As shown further shown in FIG. 4, Mi is an estimated quantity of waste ink produced per event; M is the quantity of waste ink accumulated in the gutter assembly; To is the control on-time for the gutter heater; "t" is the actual on-time for the gutter heater; To is clock time; C is actual heater temperature; Cs is the control temperature for the heater; TI is the last clock time the gutter waste emptied; and Kh is a history count of the number of waste ink producing events since the gutter was last emptied. As such, the method 500 of the present invention includes (a) performing a waste ink producing event 510 for producing phase change waste ink from the printhead system, and (b) collecting, accumulating and coalescing the phase change waste ink within a waste ink gutter assembly. The gutter assembly has a heating device 484. This is done in order to prevent the formation of undesirable stalagmites from slow and continuously dripping phase change waste ink from a constantly heated gutter assembly. The method also includes (c) maintaining the heating device in an off mode; (d) periodically turning the heating device on 530 for heating and melting coalesced phase change waste ink within the waste ink gutter; and (e) collecting melted phase change waste ink from the waste ink gutter into a waste ink collection container. As discussed above, performing a waste ink producing event can comprise purging liquid phase change ink from printheads of the printhead system as well as wiping off residual liquid phase change ink from faces of printheads of the printhead system. In either case, the controller is programmed as above to generate an estimated amount "Mi" of phase change waste ink from each such waste ink producing event.

The heating device 484 is in the off mode when collecting, accumulating and coalescing the phase change waste ink within the waste ink gutter. The method includes keeping and controlling a history of waste ink producing events 532, 534 and for determining 520 whether a value of phase change ink accumulated within the waste ink gutter has reached a control value therefor.

As can be seen, there have been provided a phase change waste ink control apparatus and method that are suitable for use in a phase change ink image producing machine including a printhead system. The apparatus for the method includes (a) devices for producing phase change waste ink such as from a printhead system; (b) a waste ink gutter assembly, including a heating device, for collecting, accumulating and coalescing the phase change waste ink. The apparatus also includes (c) a controller for periodically turning the heating device on to heat and melt coalesced phase change waste ink within the waste ink gutter assembly; and (d) a waste ink collection container for collecting melted phase change waste ink from the waste ink gutter assembly.

While the embodiment of the present invention disclosed herein is preferred, it will be appreciated from this teaching that various alternative, modifications, variations or improvements therein may be made by those skilled in the art, which are intended to be encompassed by the following claims:

What is claimed is:

1. In a phase change ink image producing machine having a printhead system using phase change ink, a phase change waste ink control method comprising:

(a) performing a waste ink producing event for producing phase change waste ink from said printhead system;

(b) collecting, accumulating and coalescing said phase change waste ink within a waste ink gutter assembly having a heating device;

(c) maintaining said heating device in an off mode;

(d) comparing a value of phase change ink accumulated within said waste ink putter assembly with a control value therefor, and periodically turning said heating device on for heating and melting coalesced phase change waste ink within said waste ink gutter assembly, when said value of phase change ink accumulated within said waste ink putter assembly has reached said control value therefor; and (e) collecting melted phase change waste ink from said waste ink gutter assembly into a waste ink collection container.

2. The method of claim 1, wherein performing a waste ink producing event comprises purging liquid phase change ink from printheads of said printhead system.

3. The method of claim 1, wherein performing a waste ink producing event comprises wiping off residual liquid phase change ink from faces of printheads of said printhead system.

4. The method of claim 1, wherein performing a waste ink producing event generates an estimated amount "Mi" of phase change waste per event.

5. The method of claim 4, wherein performing a waste ink producing event includes keeping and controlling a history of waste ink producing events.

6. The method of claim 1, wherein said heating device is in said off mode when collecting, accumulating and coalescing said phase change waste ink within said waste ink gutter assembly.

7. The method of claim 1, wherein periodically turning said heating device on includes keeping said heating device in an on mode for a predetermined period of time.

8. The method of claim 1, wherein periodically turning said heating device on includes sensing and controlling a temperature of said heating device at a predetermined control temperature.

9. The method of claim 1, wherein periodically turning said heating device on includes comparing a value of phase change ink accumulated within said waste ink gutter assembly with a control value therefor.

10. A phase change waste ink control apparatus including:

(a) means for producing phase change waste ink from said printhead system;

(b) a waste ink gutter assembly for collecting, accumulating and coalescing said phase change waste ink, said waste ink gutter assembly including a heating device;

(c) a controller for periodically turning said heating device on to heat and melt coalesced phase change waste ink within said waste ink gutter assembly, said controller being programmed to compare a value of phase change ink accumulated within said waste ink gutter assembly with a control value therefor, and to turn on said heating device when a value of phase change ink accumulated within said waste ink gutter assembly has reached said control value therefor; and (d) a waste ink collection container for collecting melted phase change waste ink from said waste ink gutter assembly.

11. The phase change waste ink control apparatus of claim 10, wherein said heating device is in an off mode for collecting, accumulating and coalescing phase change waste ink within said waste ink gutter assembly.

12. The phase change waste ink control apparatus of claim 10, wherein said controller is programmed for keeping said heating device in an on mode for a predetermined period of time.

13. A phase change ink image producing machine comprising:

(a) a control subsystem for controlling operation of all subsystems and components of the image producing machine;

(b) a movable imaging member having an imaging surface;

(c) a phase change ink system;

(d) a printhead system connected to said control subsystem and to said phase change ink system for ejecting drops of liquid phase change ink onto said imaging surface to form an image; and (d) a phase change waste ink control apparatus including:

(i) means for producing phase change waste ink from said printhead system;

(ii) a waste ink gutter assembly for collecting, accumulating and coalescing said phase change waste ink, said waste ink gutter assembly including a heating device;

(iii) a controller for periodically turning said heating device on to heat and melt coalesced phase change waste ink within said waste ink gutter assembly, said controller being programmed to compare a value of phase chance ink accumulated within said waste ink cutter assembly with a control value therefor, and to turn on said heating device when a value of phase change ink accumulated within said waste ink putter assembly has reached said control value therefor; and (iv) a waste ink collection container for collecting melted phase change waste ink from said waste ink gutter.

14. The phase change ink image producing machine of claim 13, wherein said means for producing waste ink comprises purging means for purging liquid phase change ink from printheads of said printhead system.

15. The phase change ink image producing machine of claim 13, wherein said means for producing waste ink comprises maintenance apparatus including wiper blades for wiping off residual liquid phase change ink from faces of printheads of said printhead system.

16. The phase change ink image producing machine of claim 13, wherein said heating device is in an off mode for collecting, accumulating and coalescing phase change waste ink within said waste ink gutter assembly.

17. The phase change ink image producing machine of claim 13, wherein said controller is programmed for keeping said heating device in an on mode for a predetermined period of time.

18. The phase change ink image producing machine of claim 13, wherein said controller is programmed for controlling a temperature of said heating device at a predetermined control temperature.

* * * * *